US005507539A

United States Patent [19]

Basinski

[11] Patent Number: 5,507,539

[45] Date of Patent: Apr. 16, 1996

[54] SAFETY DEVICE FOR AN ENCLOSURE DOOR

[75] Inventor: Edward M. Basinski, Manlius, N.Y.

[73] Assignee: Carrier Corporation, Syracuse, N.Y.

[21] Appl. No.: 254,856

[22] Filed: Jun. 6, 1994

[51] Int. Cl.[6] ..... E05B 65/10

[52] U.S. Cl. ..... 292/92; 292/DIG. 32; 292/DIG. 65

[58] Field of Search ..... 292/92, 21, 108, 292/210, DIG. 65, DIG. 21, DIG. 32

[56] References Cited

U.S. PATENT DOCUMENTS

| | | | |
|---|---|---|---|
| 3,352,585 | 11/1967 | Crosswell et al. | 292/92 |
| 3,871,694 | 3/1975 | White | 292/92 |
| 3,883,164 | 5/1975 | Galbreath et al. | 292/DIG. 32 X |
| 4,164,095 | 8/1979 | Musacchia | 292/21 X |
| 4,829,774 | 5/1989 | Wassibauer et al. | 62/78 |
| 4,866,963 | 9/1989 | Leininger | 292/DIG. 32 X |
| 5,072,973 | 12/1991 | Gudgel et al. | 292/92 X |
| 5,332,547 | 7/1994 | Olson et al. | 422/3 |
| 5,355,781 | 10/1994 | Liston et al. | 99/476 |

FOREIGN PATENT DOCUMENTS

| | | | |
|---|---|---|---|
| 1179317 | 1/1970 | United Kingdom | 292/DIG. 32 |

*Primary Examiner*—Rodney M. Lindsey

[57] ABSTRACT

A device (10) for preventing the opening of a door (52) into an enclosed space (50) if the atmosphere in the space is hazardous. A sensor or sensors (31) monitor the atmosphere in the space and provide a controller (32) with a signal proportional to atmospheric conditions. If the controller determines that a hazardous condition exists, it produces a signal that actuates a lock that prevents the door from being opened. In a preferred embodiment, the device prevents the opening of a door of a transport container if the proportion of oxygen in the atmosphere of the interior of the container is less than a predetermined value.

16 Claims, 3 Drawing Sheets

SAFETY DEVICE FOR AN ENCLOSURE DOOR

BACKGROUND OF THE INVENTION

This invention relates generally to the field of devices for the prevention of accidents and personal injury. More particularly, the invention relates to a device for preventing access to an enclosure in which there is a hazardous environment.

The shelf life of harvested fruits and vegetables can be extended by storing them in an environment where the atmosphere is maintained under controlled conditions. One very important parameter in preserving produce, of course, is temperature. But other atmospheric characteristics can also affect shelf life. For example, the shelf life of many fruits and vegetables is longer if they are stored in an atmosphere that contains proportions of oxygen and carbon dioxide that are greatly less than those found in normal atmospheric air. Storage containers are now available having atmosphere control systems that can achieve and maintain not only desired conditions of temperature and humidity but also the proportions of the constituent gases of the atmosphere within the container.

Unfortunately, an atmosphere that provides the optimum shelf life for produce may also be hazardous to persons who enter the space. The optimum percentage of oxygen in the atmosphere surrounding some fruits and vegetables while in storage is on the order of five percent. A person breathing air having an oxygen content of only five percent will be unconscious within seconds and dead within minutes. Considerations of personnel safety, therefore, dictate that every effort be made to prevent the entry of persons into a space where the atmosphere is hazardous until the space can be made safe. Some readily apparent steps that can be taken include the installation of warning placards at entrances to the space and the incorporation of appropriate materials in training courses for personnel that work in and around the space. Such actions, however, may not be completely effective in preventing injury.

Some refrigerated transport containers have the capability not only to maintain a desired temperature and humidity within the interior of the container but also, through other equipment provided with the refrigeration system, to attain an atmosphere having the necessary proportions of component gases for maximum shelf life of the container contents. Such an atmosphere may be hazardous because of low oxygen levels.

What is needed is a positive means of preventing the entry of persons into an enclosed space such as a container as long as the atmosphere in the space is hazardous.

SUMMARY OF THE INVENTION

The present invention is a safety device intended to be used in conjunction with the locking latch on an entry door into an enclosed space that may have an atmosphere that is hazardous to humans. The device includes a sensor or sensors capable of monitoring the atmosphere inside the space and means for activating a mechanism that will prevent the door from being opened if hazardous conditions exist.

An application for a preferred embodiment of the invention is as a safety device that will prevent the unlatching and opening of a door to a transport container having a controlled atmosphere as long as the oxygen level in the atmosphere in the interior of the container is below normal. By transport container, I mean enclosed structures for the transportation of cargo, including marine and multimodal shipping containers, railroad cars and road truck and trailer bodies.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
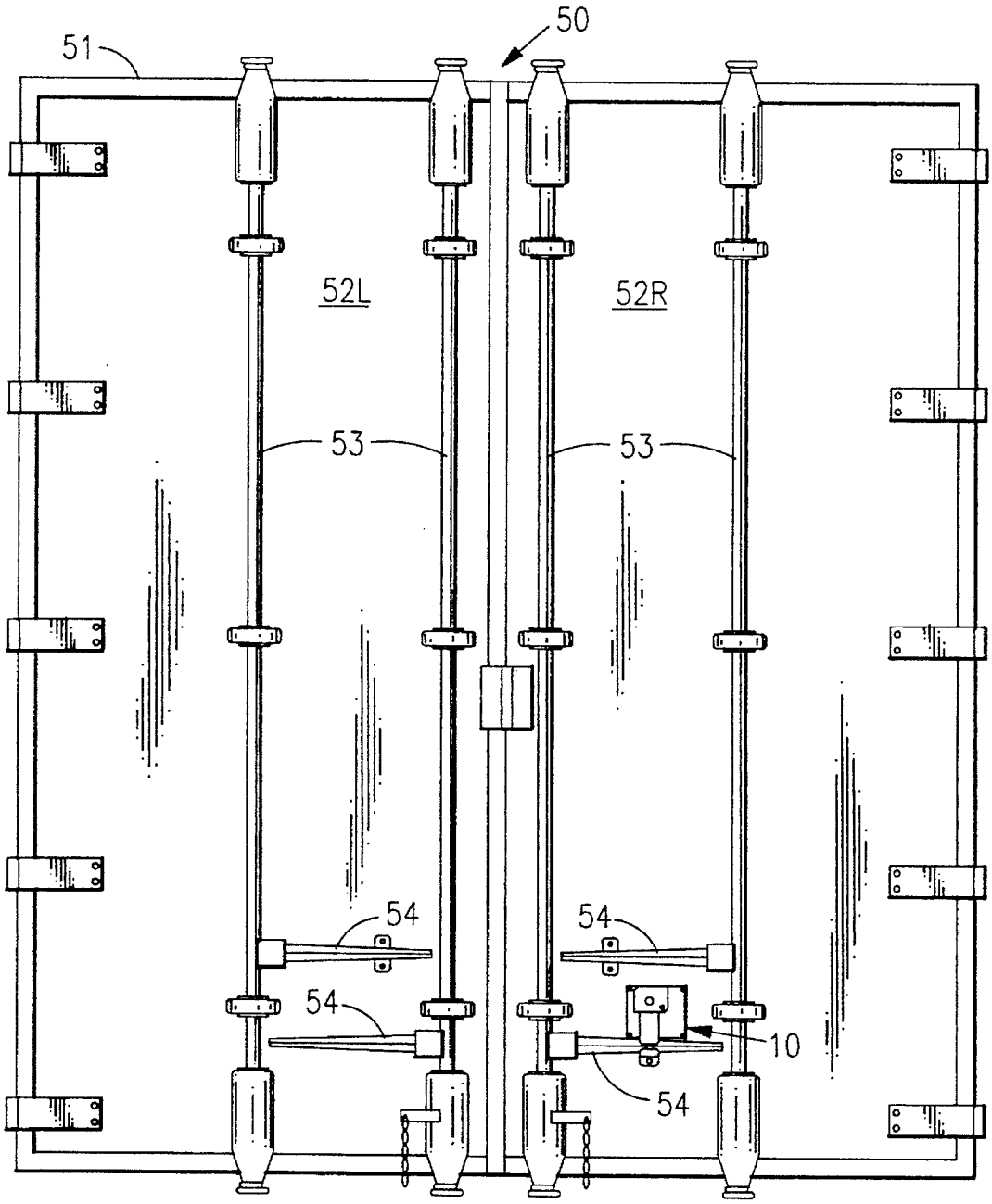
FIG. 1 is an elevation view of the rear of a transport container.

FIG. 1 depicts the rear of a standard transport container. Container 50 has shell 51 and right and left doors 52R and 52L. Latch rods 53 operate to prevent doors 52 from opening after they are shut. Latch handles 54 operate rods 53. The construction of doors 52 is such that that one, for example door 52R, must be opened before the other can be opened. If a latch handle cannot operate, then its corresponding latch rod cannot operate. If a door is shut and latched it cannot be opened unless the latch handle can operate. If both doors are shut and latched, neither door can be opened if a latch handle on the door that must open first cannot operate. It is therefore necessary to provide a locking mechanism, such as safety locking mechanism 10, on only one latch handle on the first opening door in order to prevent opening of either door to container 50.

Figure 2:
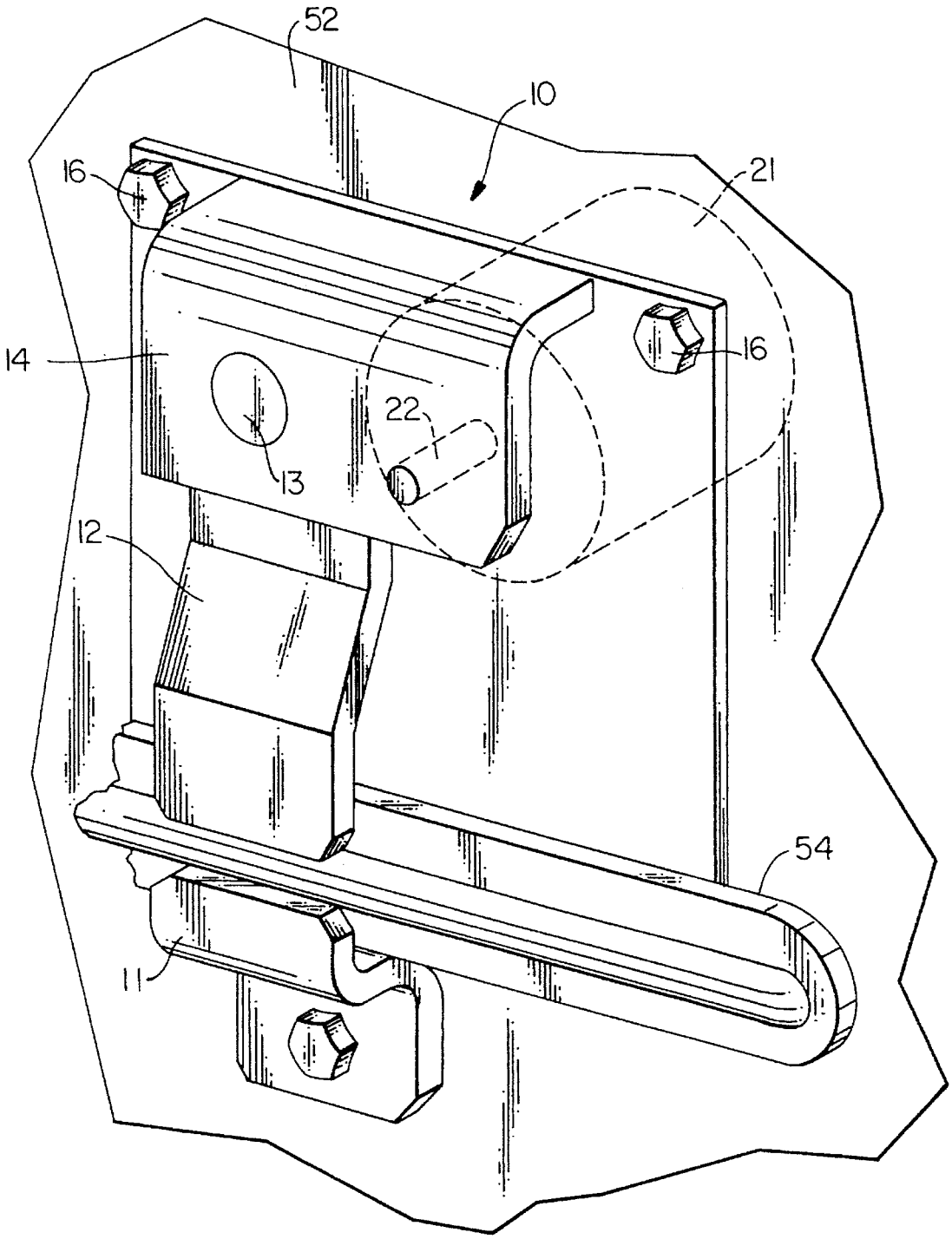
FIG. 2 is a perspective view of the latch lock mechanism for the door of a transport container as well as part of the safety device of the present invention.
Figure 3:
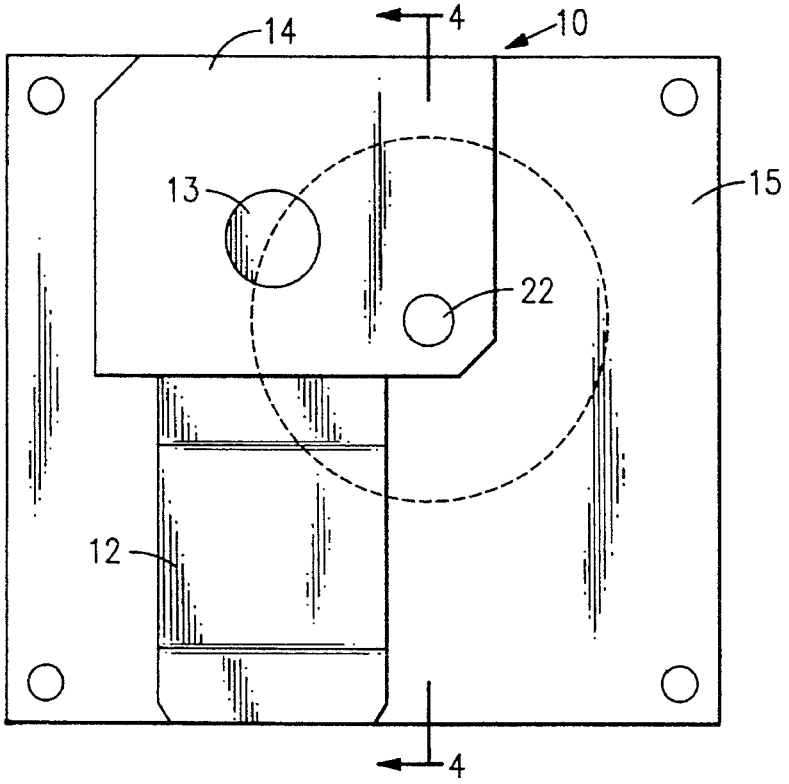
FIG. 3 is a front elevation view of the latch lock mechanism and part of the safety device of the present invention.
Figure 4:
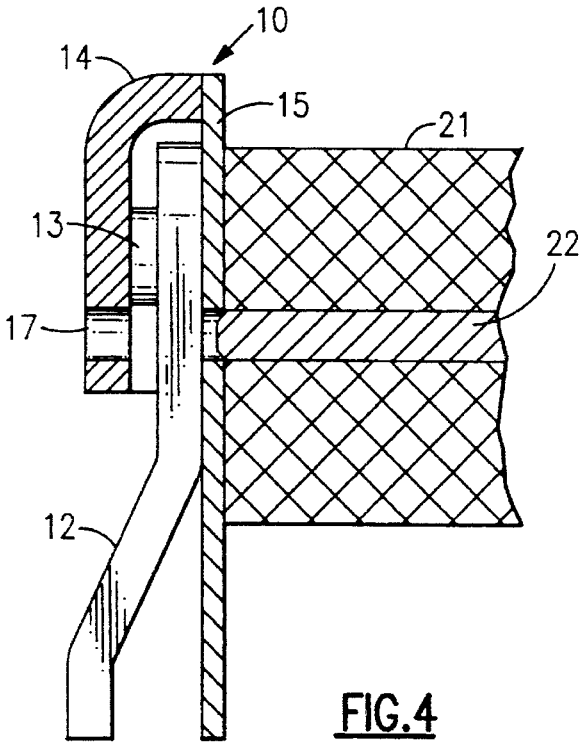
FIG. 4 is a sectioned, through line 4—4 in FIG. 3, side elevation view of the latch lock mechanism and part of the safety device of the present invention.

FIGS. 2, 3 and 4 depict, in several views, safety locking mechanism 10. Base plate 15 of mechanism 10 is secured to door 52 by bolts 16. Swing stop 12 is rotatably attached to stop mount 14 through pivot pin 13. Stop mount 14 is attached to or a part of base plate 15. When in its locked position, latch handle 54 rests in and is prevented from moving by catch 11. To open door 52, latch handle 54 is raised upward out of catch 11 and rotated outward away from the door. Swing stop 12 prevents latch handle 54 from being raised unless swing stop 12 is rotated on pivot pin 13 to a position where latch handle 54 can be lifted clear of catch 11. Solenoid 21 is throughmounted on door 52. Solenoid 21 is a bidirectional locking solenoid that is "fail as is" on loss of electrical power: when one of its two coils is energized, it extends plunger 22; when the other of its two coils is energized, it retracts plunger 22; and when neither of its coils is energized, plunger 22 remains in the position it was in when either coil was last energized. When extended, plunger 22 extends through base plate 15 and into receiver hole 17 in stop mount 14. In this position, plunger 22 prevents swing stop 12 from rotating to a position where latch handle 54 can be raised to clear catch 11 and thus, in that position, plunger 22 prevents door 52 from opening. When retracted, plunger 22 retracts into base plate 15 and swing stop 12 can be rotated to a position where latch handle 54 can be lifted clear of catch 11.

Figure 5:
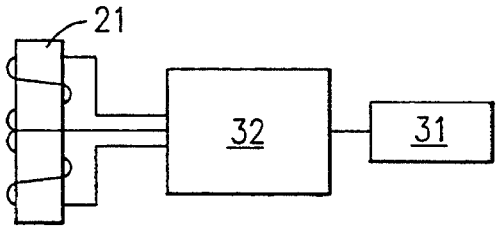
FIG. 5 is a schematic diagram of the safety device of the present invention.

FIG. 5 shows schematically the nonmechanical portions of the device of the present invention. Sensor 31 is a suitable sensor for detecting the presence and concentration of one of the constituent gases in the atmosphere within the enclosed space of interest. Controller 32 is a suitable control device that receives a signal from sensor 31, processes the signal and sends a signal to solenoid 21 to extend plunger 22 if and when the concentration of the constituent gas of interest reaches a preset limit. In a preferred embodiment, sensor 31 detects the presence and concentration of oxygen. The output of sensor 31 is a signal that is proportional to the concentration of oxygen. Controller 32 is programmed so that it issues a signal to solenoid 21 to extend plunger 22 if the output of sensor 21 indicates that the concentration of oxygen in the enclosed space of interest is less than a safe level. Similarly, controller 32 will issue a signal to solenoid 21 to retract plunger 22 if the output of sensor 21 indicates a safe concentration of oxygen. In a preferred embodiment, the set point is an oxygen concentration of about 19.8 percent, or one percentage point below the oxygen content in normal atmospheric air. Controller 32 will issue a locking signal if sensor 21 indicates an oxygen level of less than 19.8 percent and an unlocking signal with an indicated oxygen level of more than 19.8 percent.

Sensor 31 and controller 32 may be dedicated to this safety function. Alternatively, these components may serve other functions such as controlling the operation of equipment for controlling the concentration of one or more of the constituent gases in the atmosphere in the enclosed space. U.S. Pat. No. 4,829,774, issued 16 May 1989 to Wassibauer et al., U.S. Pat. No. 5,332,547, issued 26 Jul. 1994 to Olson et al. and U.S. Pat. No. 5,355,781, issued 18 Oct. 1994 to Liston et al. all disclose and describe suitable sensors and controllers for this purpose.

One may vary the configuration of the safety locking device of the present invention in a number of ways depending on the specific application in which it is used. In the configuration described above, there must be electric power available for the device to lock or unlock the container door. The configuration could be such that that loss of electrical power would cause the door to either lock or unlock. The configuration could be such that the device would not allow the door to open under any circumstances if the sensor detects a hazardous condition in the space. Alternatively, the configuration could be such that the device could be manually overriden with relative ease and thus provide only a "stop and think" function.

I claim:

1. A device (10) for locking a door (52) comprising:

sensor means (31) for sensing the presence and concentration of a gas and producing an output signal proportional to said gas concentration;

control means (32), responsive to said sensor means output signal, for producing a control signal if said sensor means output signal is within a predetermined range of values corresponding to an unsafe concentration of oxygen for human occupancy; and locking means (21, 22), responsive to said control means control signal, for locking said door upon receipt of a control signal indicating that said sensor means output signal is within said predetermined range of values.

2. The locking device of claim 1 in which said predetermined range of value corresponds to an oxygen concentration of 19.8 percent or less.

3. The locking device of claim 1 in which said control means produces a second control signal if said sensor means output signal is within a second predetermined range of values and said locking means responds to said second control signal by unlocking said door.

4. The locking device of claim 3 in which said second predetermined range of values correspond to an oxygen concentration that is safe for human occupancy.

5. The locking device of claim 4 in which said second predetermined range of values is an oxygen concentration of more than 19.8 percent.

6. A locking device (10) for a transport container door (52R) having a latch handle (54) comprising a swing stop (12) positioned with respect to said latch handle so as to be able to prevent movement of said latch handle and having a lock position in which said swing stop prevents said latch handle from moving so as to allow said door to open and an unlock position in which said latch handle may be moved so as to allow said door to open;

plunger means (22) positioned with respect to said swing stop so that when in a first position, said plunger means prevents said swing stop from moving from said lock position to said unlock position and when in a second position, said plunger means allows said swing stop to move from said lock position to said unlock position;

actuator means (21) for causing said plunger means to move between said first position and said second position;

sensor means (31), positioned so as to sense the atmosphere inside said container, for sensing the presence and concentration of a gas and for producing an output signal proportional to said gas concentration; and control means (32), responsive to said sensor means output signal, for causing said actuator means to reposition said plunger means from said first position to said second position if said sensor means output signal is within a predetermined range of values.

7. The locking device of claim 6 in which said actuator means and said plunger means are together a solenoid.

8. The locking device of claim 6 in which said gas is oxygen.

9. The locking device of claim 8 in which said predetermined range of values corresponds to an oxygen concentration that is unsafe for human occupancy.

10. The locking device of claim 9 in which said predetermined range of values corresponds to an oxygen concentration of 19.8 percent or less.

11. The locking device of claim 6 in which said control means causes said actuator means to reposition said plunger means from said second position to said first position if said sensor means output signal is within a second predetermined range of values.

12. The locking device of claim 11 in which said gas is oxygen.

13. The locking device of claim 12 in which said second predetermined range of values corresponds to an oxygen concentration that is safe for human occupancy.

14. The locking device of claim 13 in which said second predetermined range of values corresponds to an oxygen concentration of more than 19.8 percent.

15. A transport container having an enclosed interior space, a door for access into said space and means for locking said door in which the improvement comprises:

means for sensing the concentration of oxygen within said interior space and producing a sensor signal that corresponds to said gas concentration;

control means, responsive to said sensor signal, for producing a first control signal if said sensor signal is within a first range of predetermined values and a second control signal if said sensor signal is within a second predetermined range of values; and lock actuating means, responsive to said control signals, that engages said locking means in response to said first control signal and disengages said locking means in response to said second control signal.

16. The transport container of claim 15 in which said first range of predetermined values corresponds to an oxygen concentration that is unsafe for human occupancy and said second range of predetermined values corresponds to an oxygen concentration that is safe for human occupancy.

* * * * *